US007451964B2

(12) United States Patent
Hamm et al.

(10) Patent No.: US 7,451,964 B2
(45) Date of Patent: Nov. 18, 2008

(54) FENCE POSTS ASSOCIATED BY AUTO-ASSEMBLY

(75) Inventors: Valery Hamm, La Fleche (FR); Sebastien Hainos, Le Lude (FR)

(73) Assignee: Lacme Holding, La Garenne Colombes (FR)

( * ) Notice: Subject to any disclaimer, the term of this patent is extended or adjusted under 35 U.S.C. 154(b) by 107 days.

(21) Appl. No.: 11/004,965

(22) Filed: Dec. 7, 2004

(65) Prior Publication Data

US 2005/0167642 A1 Aug. 4, 2005

(30) Foreign Application Priority Data

Dec. 12, 2003 (FR) ..... 03 14577

(51) Int. Cl.
*A01K 3/00* (2006.01)

(52) U.S. Cl. ..... 256/10; 256/26; 256/65.01

(58) Field of Classification Search ..... 256/25, 256/10, 65, 67, 65.02, 26, 32, 47, 65.01
See application file for complete search history.

(56) References Cited

U.S. PATENT DOCUMENTS

| | | | | | |
|---|---|---|---|---|---|
| 404,856 | A * | 6/1889 | Ogilvie | 256/26 |
| 2,647,267 | A * | 8/1953 | McLaughlin | 5/9.1 |
| 3,204,606 | A * | 9/1965 | Parr et al. | 119/514 |
| 3,469,822 | A * | 9/1969 | O'Brien | 256/25 |
| 3,711,066 | A * | 1/1973 | Niemiec | 256/19 |
| 3,910,560 | A * | 10/1975 | Goetz | 256/24 |
| 3,988,009 | A * | 10/1976 | Mann | 256/24 |
| 4,022,436 | A * | 5/1977 | Thomas | 256/24 |
| 4,130,272 | A * | 12/1978 | Emmie | 256/22 |
| 4,370,088 | A * | 1/1983 | McShane | 414/439 |
| 4,371,148 | A * | 2/1983 | Harden | 256/26 |
| 4,623,127 | A * | 11/1986 | Wier | 256/35 |
| 4,836,143 | A * | 6/1989 | Shadbolt, Jr. | 119/514 |
| 4,919,463 | A * | 4/1990 | McQuade | 292/120 |
| 4,930,753 | A * | 6/1990 | Alvyn | 256/26 |
| 5,063,876 | A * | 11/1991 | Harris | 119/513 |
| 5,101,595 | A * | 4/1992 | Rhoades | 49/28 |
| 5,362,030 | A * | 11/1994 | Iler et al. | 256/65.08 |
| 5,794,990 | A * | 8/1998 | Coppedge | 292/153 |
| 5,964,548 | A * | 10/1999 | Akins et al. | 403/398 |
| 6,578,827 | B2 * | 6/2003 | McCracken | 256/59 |
| 6,866,251 | B2 * | 3/2005 | Rosaen | 256/25 |
| 2005/0087732 | A1 * | 4/2005 | Short | |

FOREIGN PATENT DOCUMENTS

| | | |
|---|---|---|
| EP | 0749686 | 12/1996 |
| FR | 2565780 | 12/1985 |
| FR | 2638060 | 4/1990 |

* cited by examiner

*Primary Examiner*—Daniel P Stodola
*Assistant Examiner*—Nahid Amiri
(74) *Attorney, Agent, or Firm*—Young & Thompson

(57) ABSTRACT

Fence post (1) having a point portion (2) and a principal portion (3). The principal portion is provided with connection elements to assemble a plurality of posts (1, 1'). The connection elements include assembly elements (81, 82) constituted by a female element and a male element. The male element is connected to the principal portion by means of a spacer element (83) connected to the principal portion. The assembly elements permit connecting head to tail two posts to form a pair of posts. The connecting elements also include through holes (71, 72) located on the principal portion. The through holes permit associating on connecting rods several pairs of posts.

5 Claims, 1 Drawing Sheet

FENCE POSTS ASSOCIATED BY AUTO-ASSEMBLY

The present invention relates to a post for an electric fence. More particularly, the invention relates to a post permitting rapidly setting up a temporary fence.

When the user desires to set up a fence rapidly, it is known to use posts stuck in the ground to maintain at the desired height a conductive wire to carry an electric current.

In the case of temporary fences, easy to plant and remove, it is known to use either cylindrical iron posts or glass fiber posts with plastic insulators, or posts of a more complicated shape comprising a principal portion in molded plastic carrying devices to support the conductive wire.

Generally speaking, the user moving about the parcel to be fenced uses posts from a bundle comprised by a plurality of posts. Either the posts of the bundle are simply held together by connectors when they are purchased, or the posts are in bulk when they are used. It is thus difficult to handle the bundle or to remove a single post from the bundle without the bundle coming apart.

The invention thus has for its object to provide a fence post adapted to be secured to or removed from a group of posts so as to form a bundle having a certain rigidity.

The invention has for its object a post for an electric fence comprising a point portion, of metal or plastic, adapted to be stuck in the ground and a principal portion, comprising along said principal portion one or several connection means permitting securing together a plurality of such fence posts so as to form an easily transportable bundle, characterized in that said principal portion is of plastic material, and in that said connection means are at least in part molded integrally with said principal portion.

In one embodiment, the connection means comprise pairing means to assemble the post with another such post, the pairing means being constituted by a male element and a female element, the male element being adapted to be assembled with a female element of the other such post, the female element being adapted to be assembled with a male element of the other such post.

Preferably, one of said male and female elements is connected adjacent a first end of the principal portion located on the side of the point portion, the other element being connected adjacent a second end of the principal portion located opposite the first end of the principal portion.

Preferably, the pairing means comprise a spacing element disposed radially relative to the axial direction of the post, a first end of the spacing element being connected to the principal portion, a second end of the spacing element, opposite its first end, carrying one of said male and female elements, the spacing element permitting spacing the post from the other such posts with which it is assembled.

Again preferably, the spacing means is located adjacent a first end of the principal portion adjacent the point portion, and the spacing means comprises a bearing surface generally perpendicular to the axial direction of the post, to facilitate the operation consisting in sticking the post in the ground.

In another embodiment, the connection means comprise assembly means permitting securing together a plurality, greater than two, of such posts.

Preferably, the assembly means are constituted by at least one connecting rod and at least one through hole located along the principal portion to let said connecting rod pass therethrough.

Preferably, the principal portion comprises two through holes, a first through hole being located at a first end of the principal portion located adjacent the point portion and a second through hole being located at a second end of the principal portion opposite the first end.

Again preferably, one of the through holes is a circular hole, and the other of the through holes is an oblong hole whose large axis is oriented in the axial direction of the post.

In still another embodiment, the assembly means are constituted by at least one recess-lug assembly disposed radially relative to the axial direction, the lug being adapted to coact with a corresponding recess of a second other such post, said recess being adapted to coact with a corresponding lug of a third other such post.

Preferably, the principal portion comprises two recess-lug assemblies, a first assembly being located at a first end of the principal portion located adjacent the point portion and a second assembly being located at a second end of the principal portion opposite the first end.

Preferably, the lug and recess of a same assembly are disposed radially in opposite directions.

Further preferably, the recess of said at least one recess-lug assembly is a through recess.

The first can comprise support means for the conductor located along the principal portion. In still another embodiment, the support means play the role of assembly means adapted to receive a connecting rod securing together a plurality of posts.

The invention will be better understood, and other objects, details, characteristics and advantages of the latter will become apparent more clearly, in the course of the following description, of a particular embodiment of the invention, given solely by way of illustration and not limitation, with reference to the accompanying drawings. On the drawing.

Figure 1:
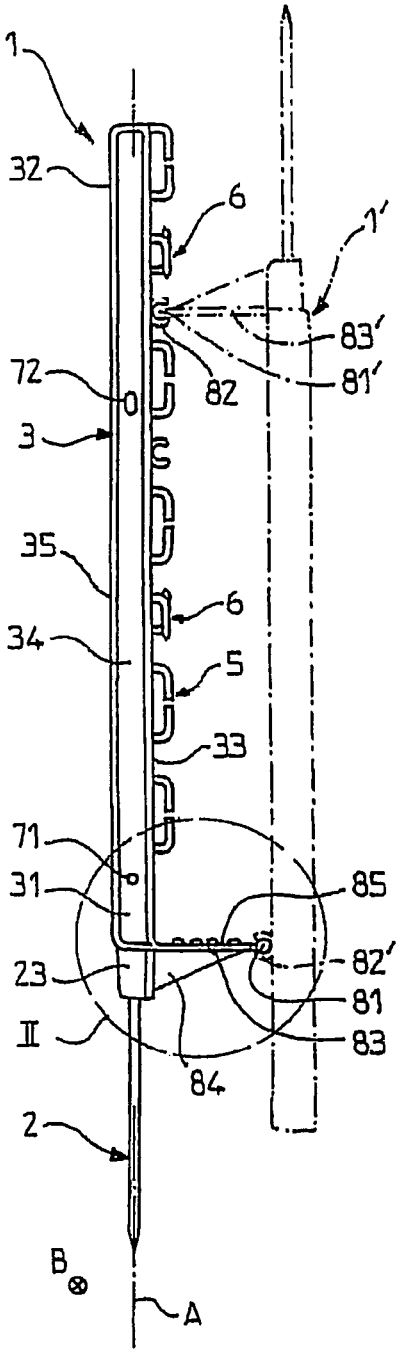
FIG. 1 is a side elevational view of a post according to the invention.

Referring to FIG. 1, the embodiment presently preferred of the post according to the invention will be described in detail. The fence post 1 defines an axial direction indicated by the axis A. The fence post 1 comprises a point portion 2 adapted to be stuck in the ground, for example of metal, and a principal portion 3, for example of molded plastic material, in known manner.

The principal portion 3 comprises a first end 31 located adjacent the point portion 2, and a second free end 32, located opposite the first end 31. The junction 23 between the metallic point portion 2 and the first end 31 of the principal portion 3 is provided by a cylindrical recess 24 having the axis A, provided in the principal portion 3. The corresponding end of the point portion is forcibly disposed in the cylindrical recess 24.

The transverse section of the principal portion 3 (FIG. 4) is of I shape and comprises a first flange 33 and a second flange 35 connected to each other by a rib 34. One of the flanges, here the flange 33, comprises support means for the conductor 5 and 6 permitting holding the conductive wire in a direction B perpendicular to the axis A.

The fence post 1 is provided with connecting means whose function is to permit the assembly of a plurality of fence posts 1 to form an easily transportable bundle that won't come apart. The bundle is a rigid group of fence posts.

The connection means comprise pairing means permitting forming a group constituted by a pair of posts. The pairing means are constituted by elements disposed along the post 1 such that they coact with corresponding elements disposed along another post 1' (shown in broken lines in FIG. 1).

In the preferred embodiment, the pairing means are constituted by a male element 81, for example a cylinder of small diameter with an axis parallel to the axis B and a female element 82. The female element 82 is for example located on the principal portion 3, adjacent the second end 32 of this latter. The male element 81 is for example located at the end of a spacing element 83 which also is a part of the pairing means. The shape of the female element 82 is complementary to that of the male element 81. The female element 82 is a portion of a hollow cylinder with an axis parallel to the axis B and having a crescent shaped cross-section, so as to receive a male element 82' of another post 1' and to permit the passage of the corresponding spacing element 83'.

Figure 2:
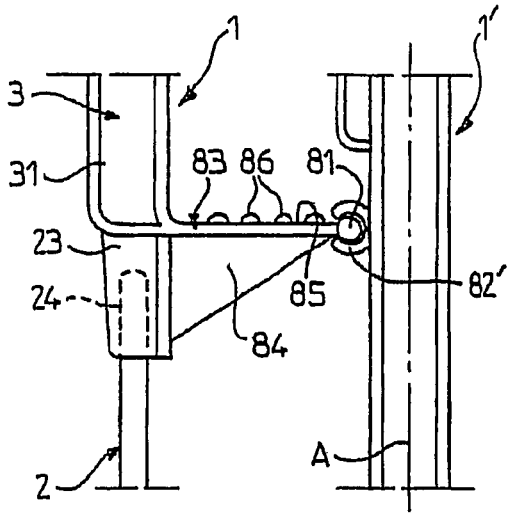
FIG. 2 is an enlarged view of the region II of FIG. 1, showing partially two fence posts connected by tailing means.

The spacing element 83 is disposed adjacent the first end 31 of the principal portion 3 and extends perpendicularly to the axial direction A of the post 1. A free end of the spacing element 83 carries the male element 81. Preferably, the spacing element 83 is flattened in a plane perpendicular to the axial direction A so as to present a flat bearing surface 85 on the side of the principal portion 3. The bearing surface 85 permits the user to stick the fence post 1 into the ground with the help of his foot by bearing on the bearing surface 85. If desired, the bearing surface 85 can be provided with non-skid grooves 86 (FIG. 2). Moreover, so as to reinforce the spacing element 83, a rib 84 can be provided between the surface of spacing element 83 opposite to the bearing surface 85 and the junction between the principal portion 3 and the point portion 2.

The connection of two fence posts thanks to the pairing means will now be described. In FIG. 1, a second fence post 1' is shown in broken lines. The first and second fence posts 1 and 1' are disposed head to tail such that the male element 81 of the first post 1 will face the female element 82' of the second post 1', and that the male element 81' of the second post 1' will face the female element 82 of the first post 1. The male and female elements are thus inter-fitted with each other either by snapping in, or by sliding parallel to the axis B, of the male elements in the female elements.

Figure 3A:
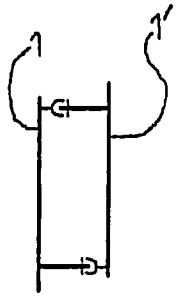
FIGS. 3A, 3B and 3C show schematically different manners of assembly pair-wise of the posts according to the invention; and, FIG. 4 is a cross-section of the assembly means according to another embodiment of the connecting means of the post according to the invention.

FIG. 3A shows a pair of posts constituted by two posts 1 and 1', according to the presently preferred embodiment, associated head to tail.

Figure 3B:
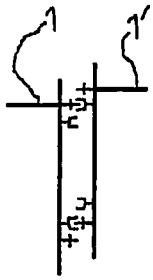

As a modification, the two posts could be associated so as to form a pair of posts of T shape (FIG. 3B). In this modification, the respective second flanges of each of the posts face each other. The pairing elements are thus provided externally on the second flange 35 of the post 1.

The two posts being exactly identical (formed from a single mold), the elements adapted to coact must be disposed facing each other. Thus, the two posts of the pair of posts being oriented in the same direction, the posts are slightly offset relative to each other along the axis A.

Figure 3C:
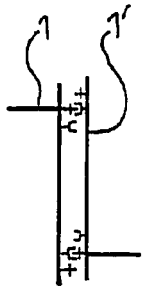

FIG. 3C again shows another modification of the embodiment of a pair of posts. The posts are associated head to tail but turned outwardly. The pairing means are thus provided externally on the second flange 35 of the posts 1 and 1'. It is to be noted that in the pairings of FIGS. 3B and 3C, the posts can if desired not be provided with the spacing element 83.

In the embodiment presently preferred, the connection means of the post 1 are constituted by assembly means permitting forming a group constituted by a plurality of posts, the plurality comprising at least three posts. It is to be noted that the post according to the invention can comprise assembly means without at the same time comprising pairing means having the function of associating two posts.

Referring to FIG. 1, the assembly means comprise a plurality of through holes disposed along the principal portion 3. The through holes pass from side to side of the rib 34, along the axis B. More particularly, the principal portion 3 comprises a first through hole 71 adjacent its first end 31 and has a second through hole 72 adjacent its second end 32. Preferably, the first through hole 71 is of circular shape whilst the second through hole 72 is of oblong shape, the large axis of this oblong hole being oriented along the axis A. The through holes 71 and 72 are adapted to coact with a connecting rod as will now be described.

Preferably, the assembly means permit forming a group constituted of several pairs of posts made as has been described above. The pairs of posts are superposed on each other, if desired in alternation: the posts, for example on the right, of each of the pairs of posts is one time point upward and one time point downward. In this latter case, the through holes on the principal portions of the posts of the superposed pairs coincide along four axes. One connected connection rod can thus be sunk through a succession of through holes to hold frictionally the corresponding posts. The fact that up to four rods can be used ensures a rigidity of the bundle thus constituted. Moreover, the fact that one through hole 72 of two along the axis of the connecting rod will be an oblong hole, reduces the friction and permits the user easily to detach one of the pairs of posts from the bundle.

Figure 4:
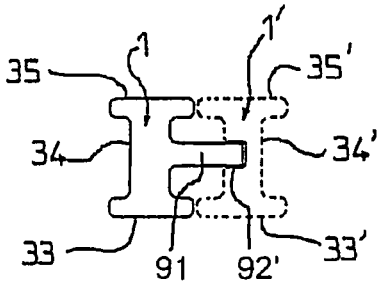

In another embodiment, shown in FIG. 4, the assembly means are constituted by at least one lug-recess assembly, in variance from the assembly of the connected rod—through hole. Preferably, the post comprises two such lug-recess assemblies disposed respectively at each of its ends of the principal portion 3 so as to permit a reliable assembly.

The post 1 comprises a lug 91 disposed on one side of the rib 34 and extending radially so as to project beyond the first and second flanges 33 and 35 of the post 1. Like the post 1' shown in broken lines, the post 1 also comprises a recess 92, or non-through hole, located on the surface of the rib 34 opposite the surface carrying the lug 91.

To assemble the post 1 with the second identical post 1', the lug 91 of the post 1 is disposed facing the corresponding recess 92' of the post 1' and is forcibly engaged in the recess 92'. The lug and the recess of a same assembly being disposed on opposite sides of the rib 34, the recess 92 of the post 1 is adapted to receive the lug of a third post.

If the posts are made from the same mold, and so as not to render fragile the central rib 34, the recess 92 is not necessarily positioned at the same height along the post as the lug 91. As a result, two posts secured by these assembly means will be slightly offset relative to each other, for example by a predetermined downward interval. So that a third post, associated with the two preceding ones, will not be offset downwardly by the predetermined interval, it is possible to provide only a single recess-lug assembly comprising for example two adjacent recesses (or two adjacent lugs) spaced twice by said predetermined interval and one lug (one recess). Thus, the third post of the bundle will be at the level of the first post of the bundle.

As a modification, the recess can be a through hole into which the lug is snapped.

In still another modification, the support means for the conductor 5 or 6 can serve as the assembly means. A connected rod adjusting perfectly to the support means of the conductor 5 or 6 permits forming a group constituted by a plurality of posts. As a modification, the shape of the support means for the conductor 5, 6 is arranged to ensure the connection of one post to another.

Thus, the post according to the invention is easily associated with other posts to form a rigid bundle, easy to store and to move.

Although the invention has been described in connection with a particular embodiment, it is evident that it is no way thereby limited and that it comprises all the technical equivalents of the means described, as well as their combinations if these enter into the scope of the invention.

The invention claimed is:

1. A pair of identical fence posts, each fence post having a projecting male member and a female member spaced apart lengthwise of the fence post, each male member being fixed relative to its associated said fence post, the two fence posts being arranged in reversed relationship such that the male member of one fence post engages releaseably with the female member of the other fence post and the male member of said other fence post engages releaseably with the female member of said one fence post thereby to hold the two fence posts releaseably together in spaced parallel relationship, the male and female members of each fence post facing the other fence post of the pair.

2. The pair of fence posts as claimed in claim 1, each one of the fence posts having at least one hole therethrough such that each pair of fence posts has at least two said holes through which rods can be passed so as to hold together a bundle of pairs of fence posts in a bundle.

3. The pair of fence posts as claimed in claim 1, each one of the fence posts having two longitudinally spaced holes therethrough such that each pair of fence posts has four said holes through which up to four rods can be passed so as to hold together a plurality of pairs of fence posts in a bundle.

4. The pair of fence posts as claimed in claim 3, at least one said hole of each one of the fence posts being oblong.

5. The pair of fence posts as claimed in claim 1, each fence post having only one said male member and only one said female member.

* * * * *